US007860721B2

(12) United States Patent
Tsushima et al.

(10) Patent No.: US 7,860,721 B2
(45) Date of Patent: Dec. 28, 2010

(54) AUDIO ENCODING DEVICE, DECODING DEVICE, AND METHOD CAPABLE OF FLEXIBLY ADJUSTING THE OPTIMAL TRADE-OFF BETWEEN A CODE RATE AND SOUND QUALITY

(75) Inventors: Mineo Tsushima, Nara (JP); Yoshiaki Takagi, Kanagawa (JP); Kojiro Ono, Osaka (JP); Naoya Tanaka, Osaka (JP); Shuji Miyasaka, Osaka (JP)

(73) Assignee: Panasonic Corporation, Osaka (JP)

( * ) Notice: Subject to any disclaimer, the term of this patent is extended or adjusted under 35 U.S.C. 154(b) by 1066 days.

(21) Appl. No.: 11/597,558

(22) PCT Filed: Sep. 13, 2005

(86) PCT No.: PCT/JP2005/016794

§ 371 (c)(1),
(2), (4) Date: Nov. 27, 2006

(87) PCT Pub. No.: WO2006/030754

PCT Pub. Date: Mar. 23, 2006

(65) Prior Publication Data

US 2008/0059203 A1 Mar. 6, 2008

(30) Foreign Application Priority Data

Sep. 17, 2004 (JP) ..... 2004-272444

(51) Int. Cl.
*G10L 19/00* (2006.01)

(52) U.S. Cl. ..... 704/501

(58) Field of Classification Search ..... 704/500–503
See application file for complete search history.

(56) References Cited

U.S. PATENT DOCUMENTS 5,230,038 A * 7/1993 Fielder et al. ..... 704/229
5,479,562 A * 12/1995 Fielder et al. ..... 704/229
5,736,943 A 4/1998 Herre et al.

(Continued)

FOREIGN PATENT DOCUMENTS

JP 8-507424 8/1996

(Continued)

OTHER PUBLICATIONS

M. Bosi et al., ISO/IEC13818-7:1997(E), ISO IEC JTC1/SC29/WG11 N1650, IS13818-7 (Mpeg-2 Advanced Audio Coding, AAC), Apr. 1997, pp. 1-107, Plus Annex pp. 1-74.
ISO/IEC JTC1/SC29/WG11/N6130, ISO/IEC14496-3:2001/FDAM2 (Parametric Coding for High Quality Audio), Waikoloa, Hawaii, Dec. 2003, pp. i-iv, and pp. 1-116.

*Primary Examiner*—Michael N Opsasnick
(74) *Attorney, Agent, or Firm*—Wenderoth, Lind & Ponack, L.L.P.

(57) ABSTRACT

Provided are an audio encoding device and an audio decoding device, by which optimal trade-off between code rates and sound quality can be flexibly adjusted. A variable frequency segmentation encoding unit includes: difference degree calculation units for calculating a difference degree between first and second input signals depending on a segmentation method for segmenting a frequency band into sub-bands; a selection unit for selecting one of the segmentation methods; and a difference degree and segmentation information encoding unit for encoding the selected method and the difference degree for each sub-band. A variable frequency segment decoding unit includes: a segmentation information decoding unit for decoding the segmentation information to learn the segmentation method; a switching unit for outputting a difference degree code corresponding to the segmentation method; and difference degree decoding units for decoding the difference degree code to the difference degree for each sub-band.

11 Claims, 6 Drawing Sheets

U.S. PATENT DOCUMENTS

| | | | | |
|---|---|---|---|---|
| 5,752,225 | A * | 5/1998 | Fielder | 704/229 |
| 6,339,756 | B1 * | 1/2002 | Hinderks | 704/201 |
| 6,473,731 | B2 * | 10/2002 | Hinderks | 704/200.1 |
| 6,487,535 | B1 * | 11/2002 | Smyth et al. | 704/500 |
| 7,283,955 | B2 * | 10/2007 | Liljeryd et al. | 704/219 |
| 7,395,209 | B1 * | 7/2008 | Mesarovic et al. | 704/500 |
| 7,542,896 | B2 * | 6/2009 | Schuijers et al. | 704/201 |
| 2003/0035553 | A1 | 2/2003 | Baumgarte et al. | |
| 2003/0219130 | A1 | 11/2003 | Baumgarte et al. | |
| 2004/0078196 | A1 | 4/2004 | Abe et al. | |
| 2004/0172240 | A1 | 9/2004 | Crockett et al. | |
| 2008/0170711 | A1 * | 7/2008 | Breebaart et al. | 381/77 |

FOREIGN PATENT DOCUMENTS

| | | |
|---|---|---|
| JP | 2003-132041 | 5/2003 |
| JP | 2003-271168 | 9/2003 |
| JP | 2004-528599 | 9/2004 |
| JP | 2005-523480 | 8/2005 |
| WO | 95/08227 | 3/1995 |
| WO | 02/097790 | 12/2002 |
| WO | 03/036510 | 5/2003 |
| WO | 03/090208 | 10/2003 |
| WO | 2004/036549 | 4/2004 |

* cited by examiner (A)

(B)

(C)

| Representative Value | Huffman Code Length |
|---|---|
| +1 | 9bits |
| +0.9 | 6bits |
| +0.8 | 3bits |
| +0.5 | 2bits |
| -0.5 | 2bits |
| -0.8 | 3bits |
| -0.9 | 5bits |
| -1 | 9bits |

AUDIO ENCODING DEVICE, DECODING DEVICE, AND METHOD CAPABLE OF FLEXIBLY ADJUSTING THE OPTIMAL TRADE-OFF BETWEEN A CODE RATE AND SOUND QUALITY

TECHNICAL FIELD

The present invention relates to an encoding device and a decoding device for audio signals, and more particularly to a technology capable of flexibly adjusting the optimal trade-off between a code rate and sound quality.

BACKGROUND ART

Conventionally, audio encoding and decoding methods, which are international standards by ISO/IEC, have been widely known, for example, so-called MPEG methods. Presently, there is an encoding method known as ISO/IEC13818-7, called MPEG-Advanced Audio Coding (MPEG-2AAC), which has wide applications and aims at encoding high-quality audio signals at low bit rates.

According to this AAC, when audio signals detected by multiple channels are to be encoded, a correlation between the channels is obtained using a system called a Mid Side (MS) stereo or an intensity stereo, and the correlation is considered in compressing the audio data to improve coding efficiency.

In the MS stereo, stereo signals are represented by a sum signal and a difference signal, each of which is allocated with a different coding amount. On the other hand, in the intensity stereo, each frequency band of signals from plural channels is segmented into multiple sub-bands, and a level difference and a phase difference (the phase difference has two stages of an in-phase and an anti-phase) in signals between the channels are encoded regarding each of the sub-bands.

A number of standards extended from this AAC are currently being developed. In the development, a coding technology using information called spatial cue information or binaural cue information is planned to be introduced. One example of such a coding technology is a parametric stereo system according to a MPEG-4 Audio (non-patent reference 1) which is an international standard by the ISO. Other examples are technologies disclosed in patent references 1 and 2.

[Patent Reference 1] U.S. Patent Application Publication No. 2003/0035553 entitled "Backwards-compatible Perceptual Coding of Spatial Cues"

[Patent Reference 2] U.S. Patent Application Publication No. 2003/0219130 entitled "Coherence-based Audio Coding and Synthesis"

[Non-Patent Reference 1] ISO/IEC 14496-3:2001 AMD2 "Parametric Coding for High Quality Audio"

SUMMARY OF INVENTION

Problem that Invention is to Solve

However, the conventional audio encoding method and audio decoding method have a problem that, when the difference in signals between the channels is encoded for each sub-band, such sub-band is segmented by a fixed method, which fails to flexibly adjust the optimal trade-off between a code rate and sound quality. In view of the conventional problem, an object of the present invention is to provide an audio encoding device, an audio decoding device, methods thereof, and a program thereof, which are capable of flexibly adjust the optimal trade-off between a code rate and sound quality.

Means to Solve the Problem

In order to solve the above problem, an audio encoding device according to the present invention encodes a degree of a difference between plural audio signals which are to be separated from a representative audio signal. The audio encoding device includes: a selecting unit which selects one of plural segmentation methods for segmenting a frequency band into one or more sub-bands; a difference degree encoding unit which encodes the degree of the difference between the audio signals, for each sub-band obtained by the selected segmentation method; and a segmentation information encoding unit which encodes segmentation information for identifying the selected segmentation method.

Further, it is preferable that the number of the sub-bands obtained by each of the plural segmentation methods differs depending on the segmentation method, and that the plural segmentation methods include: a first segmentation method for segmenting the frequency band into one or more sub-band; and a second segmentation method for segmenting the frequency band into plural sub-bands, and one of the sub-bands obtained by the first segmentation method is equivalent to one of: one of the sub-bands obtained by the second segmentation method; and a band in which some of adjacent sub-bands obtained by the second segmentation method are grouped.

Furthermore, the degree of the difference may be a difference in energy between the audio signals, or may be coherence between the audio signals. The representative audio signal may be a mixed-down signal to which the audio signals are mixed down.

With the above structure, the encoding can be performed using an appropriate segmentation method depending on a code rate, so that it is possible to flexibly adjust the optimal trade-off between the code rate and sound quality.

Still further, the audio encoding device further includes a difference degree calculation unit which calculates the degree of the difference between the audio signals, for each sub-band obtained by the selected segmentation method, the calculation being performed for the first segmentation method and the second segmentation method, as the selected segmentation method. Here, the selecting unit is operable to select one of the first segmentation method and the second segmentation method, depending on a deviation between the calculated degrees of the difference for the sub-bands obtained by the second segmentation method, and the difference degree information encoding unit is operable to encode the degree of the difference calculated for each sub-band obtained by the selected segmentation method.

With the above structure, plural sub-bands having similar difference degrees between the audio signals are processed together as one set, so that it is possible to reduce the code rate without significant damage on the sound quality, thereby improving coding efficiency.

In order to solve the above problem, an audio decoding device according to the present invention decodes encoded audio signal data which includes: a difference degree code in which the degree of the difference between plural audio signals, which are to be separated from a representative audio signal, is encoded for each sub-band obtained by one of plural segmentation methods for segmenting a frequency band into one or more sub-bands; and a segmentation information code in which segmentation information for identifying the segmentation method used to encode the difference degree code is encoded. The audio decoding device includes: a segmentation information decoding unit which decodes the segmentation information code to the segmentation information; and a difference degree information decoding unit which decodes the difference degree code to the degree of the difference between the audio signals for each sub-band obtained by the segmentation method identified by the segmentation information.

With the above structure, it is possible to obtain audio signals by appropriately decoding the encoded audio signal data, based on the segmentation information code. The encoded audio signal data is obtained by the above-mentioned audio encoding device, realizing the appropriate trade-off between the code rate and the sound quality.

Note that the present invention can be realized not only as the audio encoding device and the audio decoding device, but also as: encoded audio signal data obtained by the audio encoding device; an audio encoding method and an audio decoding method having steps which are processing performed by the audio encoding device and the audio decoding device; a computer program and a recording medium in which the computer program is recorded. Moreover, the present invention may be realized as an integrated circuit device which performs the audio encoding and the audio decoding.

EFFECTS OF THE INVENTION

The audio encoding method and the audio decoding method according to the present invention have: a selecting unit which selects one of plural methods for segmenting a frequency band into one or more sub-bands; and a difference degree encoding unit which encodes, regarding each of the sub-band segmented by the selected segmentation method, a degree of a difference between plural audio signals, so that the encoding can be performed according to sub-bands obtained by an appropriate segmentation method depending on a code rate, which makes it possible to flexibly adjust the optimal trade-off between the code rate and sound quality.

Especially, it can be conceived a structure in which, depending on the degrees of the difference between the audio signals which are obtained for the plural sub-bands, the plural sub-bands are processed together as one set. With the structure, the plural sub-bands having similar difference degrees are processed together as one set, so that it is possible to reduce a code rate without significant damage to sound quality, thereby improving coding efficiency.

NUMERICAL REFERENCES

Figure 1:
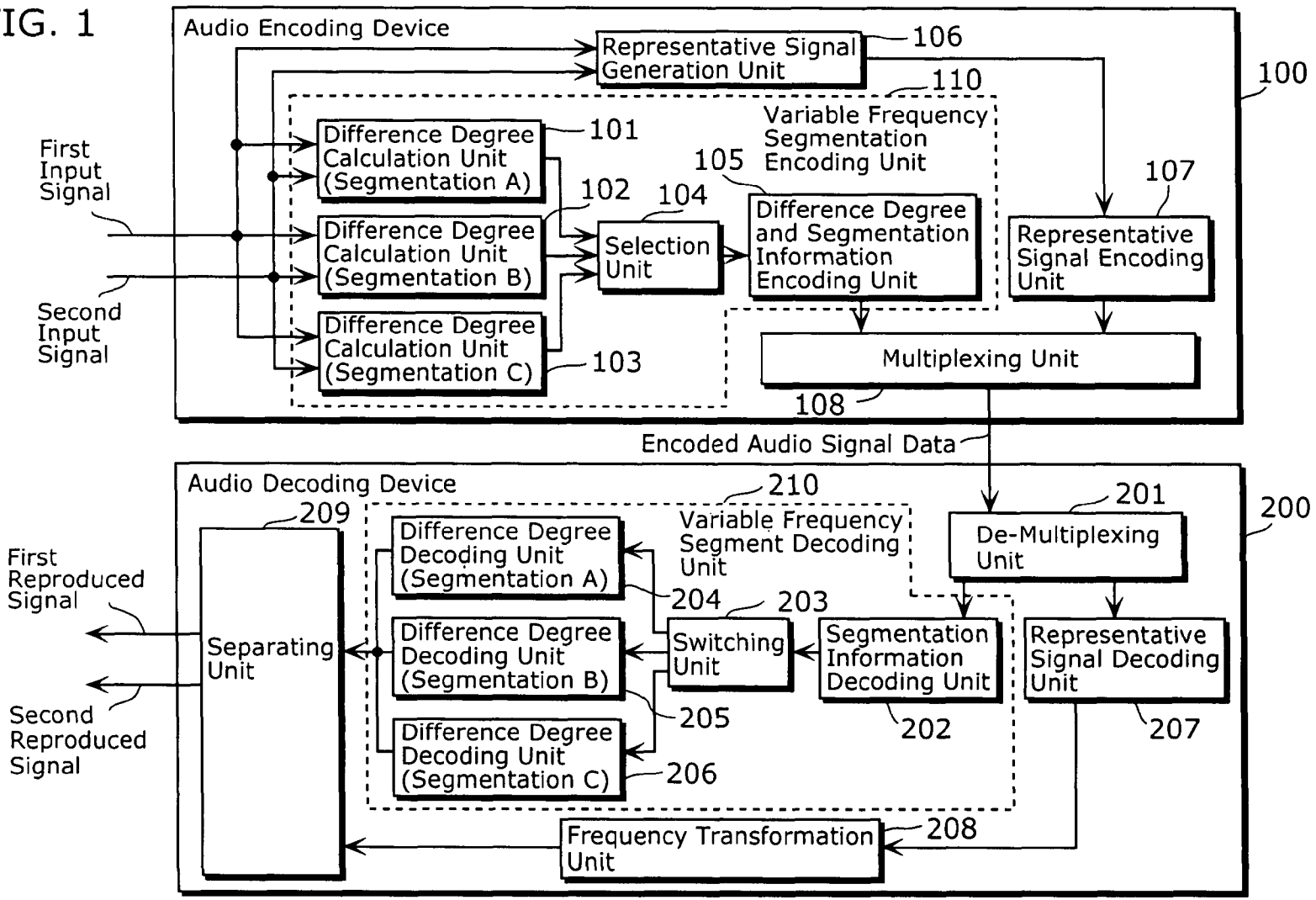
FIG. 1 is a block diagram showing one example of a functional structure of an audio encoding device and an audio decoding device according to an embodiment of the present invention.

100 audio encoding device
101, 102, 103 difference degree calculation unit
104 selection unit
105 difference degree and segmentation information encoding unit
106 representative signal generation unit
107 representative signal encoding unit
108 multiplexing unit
110 variable frequency segmentation encoding unit
200 audio decoding device
201 de-multiplexing unit
202 segmentation information decoding unit
203 switching unit
204, 205, 206 difference degree decoding unit
207 representative signal decoding unit
208 frequency transformation unit
209 separating unit
210 variable frequency segment decoding unit
300 audio encoding device
306 mixing-down unit
307 AAC encoding unit
308 multiplexing unit
310 variable frequency segmentation encoding unit
400 audio decoding device
401 de-multiplexing unit
407 AAC decoding unit
408 frequency transformation unit
409 separating unit
410 variable frequency segment decoding unit

DETAILED DESCRIPTION OF THE INVENTION

The following describes a preferred embodiment of the present invention with reference to the drawings.

FIG. 1 is a block diagram showing one example of a functional structure of an audio encoding device 100 and an audio decoding device 200 according to the present embodiment.

(Audio Encoding Device 100)

The audio encoding device 100 is a device which encodes: one representative audio signal; and a degree of a difference (difference degree) between plural audio signals which are to be separated from the representative audio signal for reproduction. The audio encoding device 100 includes a variable frequency segmentation encoding unit 110, a representative signal generation unit 106, a representative signal encoding unit 107, and a multiplexing unit 108. The variable frequency segmentation encoding unit 110 has: difference degree calculation units 101, 102, and 103; a selection unit 104; and a difference degree and segmentation information encoding unit 105.

In the present embodiment, it is assumed that two audio signals called the first input signal and the second input signal are given as examples of the plural audio signals, so that (i) a representative audio signal representing the both signals and (ii) a difference degree between the both signals are to be encoded.

In the present invention, the first input signal, the second input signal, and the representative audio signal are not limited to any certain signals. Typical examples of the first input signal and the second input signal may be audio signals detected by respective channels of a right stereo and a left stereo. A typical example of the representative audio signal may be a monaural signal obtained by summing the first input signal and the second input signal.

In the above example, the representative signal generation unit 106 mixes the first input signal and the second input signal down to the monaural signal, and then the representative signal encoding unit 107 encodes the resulting monaural signal into the representative signal code, using an audio codec for single-channel signals which conforms to the AAC standard, for example.

Each of the difference degree calculation units 101, 102, and 103 encodes, for each predetermined unit time, a difference degree between the first input signal and the second input signal. The encoding is performed for each of sub-bands which are determined by segmenting, using a segmentation method, a frequency band including perceivable frequency. The segmentation method is different depending on the difference degree calculation unit.

In the present invention, the degrees of the difference are not limited to any practical physical amounts. One example of the difference degree may be expressed by: Inter-Channel Coherence (ICC) representing coherence between the channels; Inter-channel Level Difference (ILD) representing a level difference between the channels; Inter-channel Phase Difference (IPD) representing a phase difference between the channels; or the like. Further, this difference degree may be a degree of a difference between signals in frequency domain which are obtained by time-frequency transformation of the first input signal and the second input signal, respectively.

The present invention is characterized in that such a difference degree is obtained regarding each sub-band determined by a method which is selected from plural methods for segmenting a frequency band.

Figure 2:
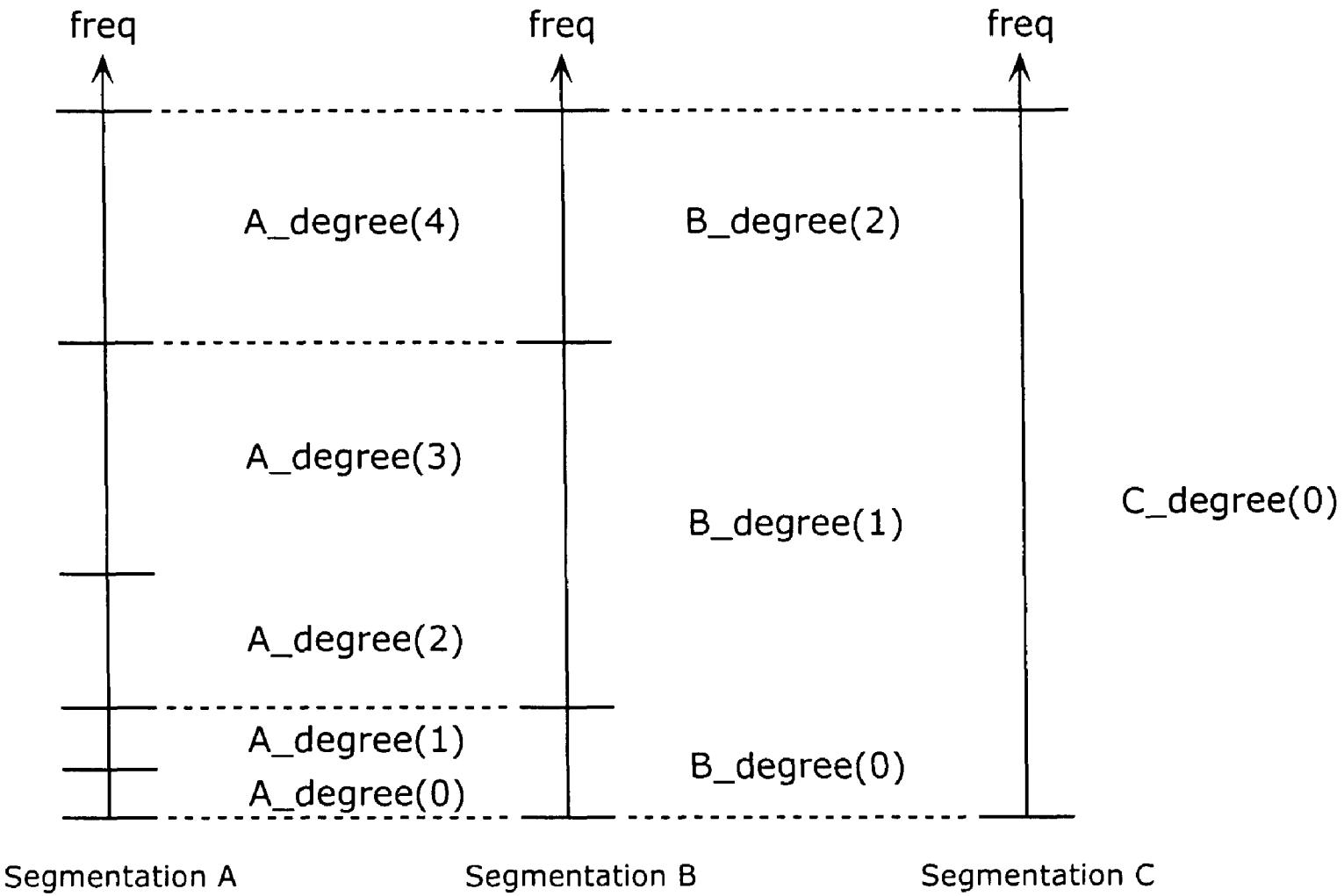
FIG. 2 is a diagram showing one example of segmentation methods for segmenting a frequency band into multiple sub-bands.

FIG. 2 is a diagram showing segmentation A, segmentation B, and segmentation C, which are segmentation methods used by the difference degree calculation units 101, 102, and 103, respectively. Referring to FIG. 2, a frequency band is segmented more coarsely in an order of the segmentation A, the segmentation B, and the segmentation C, thereby determining five sub-bands, three sub-bands, and one sub-band, respectively. In practical use, the frequency band is actually segmented into more sub-bands, but in the following, the frequency band is segmented into the above-numbered sub-bands, as an example for conciseness.

In the segmentation B, the five sub-bands A_degree(0), . . . , A_degree(4) determined in the segmentation A are grouped, from a lower frequency by two, two, and one, into respective sets, thereby determining sub-bands B_degree(0), B_degree(1), and B_degree(2).

In the segmentation C, the three sub-bands B_degree(0), B_degree(1), and B_degree(2) determined in the segmentation B are grouped into one set, thereby determining a sub-band C_degree(0).

Note that, like A_degree(4) and B_degree(2), two segments may define an identical sub-band. Note also that the number of grouped sub-bands in one set is not limited to the above, but, of course, four or more sub-bands may be grouped together.

Regarding each of the five sub-bands determined in the segmentation A, the difference degree calculation unit 101 calculates, for each unit time, a difference degree in frequency domain between the first input signal and the second input signal.

Prior to the calculation, the difference degree calculation unit 101 firstly performs time-frequency transformation, in order to transform, for each unit time, time waveforms of the first input signal and the second input signal into respective signals in frequency domain. This transformation is performed using a known technology, such as Fast Fourier Transformation (FFT).

Then, assuming that the difference degrees are to be expressed by ICC, the difference degree calculation unit 101 calculates each ICC in frequency domain regarding the five sub-bands A_degree(0), . . . , A_degree(4), using sample values x(i) and y(i) (i is a sampled point on a frequency axis) which are respective frequency-domain signals of the first input signal and the second input signal, according to the following equation (1).

[Equation 1]

$$\text{A_degree}(n) = ICC(n) = \frac{\sum_{i \in A(n)} (x(i) * y(i))}{\sqrt{\sum_{i \in A(n)} (x(i) * x(i)) \sum_{i \in A(n)} (y(i) * y(i))}} \quad (1)$$

n (n=0, . . . , 4) is a sub-band number.

A(n) is an n-th sub-band determined by the segmentation A.

In the same manner, the difference degree calculation unit 102 calculates, for each unit time, each ICC in frequency domain regarding the three sub-bands determined in the segmentation B, B_degree(0), B_degree(1), B_degree(2), according to the following equation (2).

[Equation 2]

$$\text{B_degree}(n) = ICC(n) = \frac{\sum_{i \in B(n)} (x(i) * y(i))}{\sqrt{\sum_{i \in B(n)} (x(i) * x(i)) \sum_{i \in B(n)} (y(i) * y(i))}} \quad (2)$$

n (n=0, 1, 2) is a sub-band number.

B(n) is an n-th sub-band determined by the segmentation B.

In the same manner, the difference degree calculation unit 103 calculates, for each unit time, ICC regarding the sub-band C_degree(0) which defines the whole non-segmented frequency band, according to the following equation (3).

[Equation 3]

$$\text{C_degree}(0) = ICC(0) = \frac{\sum_{i \in C} (x(i) * y(i))}{\sqrt{\sum_{i \in C} (x(i) * x(i)) \sum_{i \in C} (y(i) * y(i))}} \quad (3)$$

C is all area of frequency band.

The difference degree calculation units 101, 102, and 103 output those difference degrees calculated as described above, to the selection unit 104.

Assuming that the difference degrees regarding respective sub-bands are to be encoded with the same coding amount, it is obvious, from the difference in the number of the sub-bands, that the difference degrees in each segmentation are encoded with a code rate which is gradually reduced in an order of the segmentation A, the segmentation B, the segmentation C.

Note that, in the above example, the difference degrees have been expressed by ICC, but when the difference degrees are to be expressed by ILD instead, the difference degrees are determined according to the following equation (4), for example.

[Equation 4]

$$\text{A_degree}(n) = ICC(n) = \sum_{i \in A(n)} (x(i) * x(i)) \Big/ \sum_{i \in A(n)} (y(i) * y(i)) \quad (4)$$

n (n=0, . . . , 4) is a sub-band number.

A(n) is an n-th sub-band determined by the segmentation A.

The selection unit 104 selects one segmentation for the encoding, among the segmentation A, the segmentation B, and the segmentation C.

If, for example, a coding amount available for the encoding is not enough, in other words, if a code rate is low, the selection unit 104 selects the segmentation C that can be encoded at a relatively low code rate. Then, the difference degree obtained from the difference degree calculation unit 103 is outputted to the difference degree and segmentation information encoding unit 105.

On the other hand, if the available coding amount is enough, in other words, if the code rate is high, the selection unit 104 selects the segmentation A that can be encoded at a relatively high code rate, so that the difference degrees can be expressed more accurately. Then, the difference degrees obtained from the difference degree calculation unit 101 are outputted to the difference degree and segmentation information encoding unit 105.

Moreover, as another selecting method, the selection unit 104 may firstly select the segmentation A. Here, if the difference degrees calculated by the difference degree calculation unit 101 are substantially the same, the selection unit 104 re-selects the segmentation B instead of the segmentation A. Here, if the difference degrees calculated by the difference degree calculation unit 102 are substantially the same, the selection unit 104 re-selects the segmentation C instead of the segmentation B. Thereby, the difference degrees calculated by the difference degree calculation unit corresponding to the finally selected segmentation are outputted to the difference degree and segmentation information encoding unit 105.

Here, "the difference degrees . . . are substantially the same" means that, for example, a deviation (difference between a maximum value and a minimum value) between the difference degrees calculated regarding plural sub-bands which are grouped as one set in the next coarser segmentation is judged as trivial, so that there is no problem if the difference degrees of the sub-bands are regarded to have the same values. Here, this judging is made by comparing the deviation to a predetermined certain threshold value.

When the segmentation C, for example, is selected by this selecting method, eventually all difference degrees become substantially the same, as shown in an equation (5), so that this selecting is appropriate in view of coding efficiency.

[Equation 5]

$$\begin{aligned} &\text{A_degree}(0) \cong \text{A_degree}(1) \cong \text{A_degree}(2) \cong \\ &\quad \text{A_degree}(3) \cong \text{A_degree}(4) \cong \text{B_degree}(0) \cong \\ &\quad\quad \text{B_degree}(1) \cong \text{B_degree}(2) \cong \text{C_degree}(0) \end{aligned} \quad (5)$$

The difference degree and segmentation information encoding unit 105 encodes segmentation information for identifying the segmentation selected by the selection unit 104, thereby generating a segmentation information code. Further, the difference degree and segmentation information encoding unit 105 also encodes each difference degree regarding the sub-bands determined by the selected segmentation, thereby generating each difference degree code.

Figure 3:
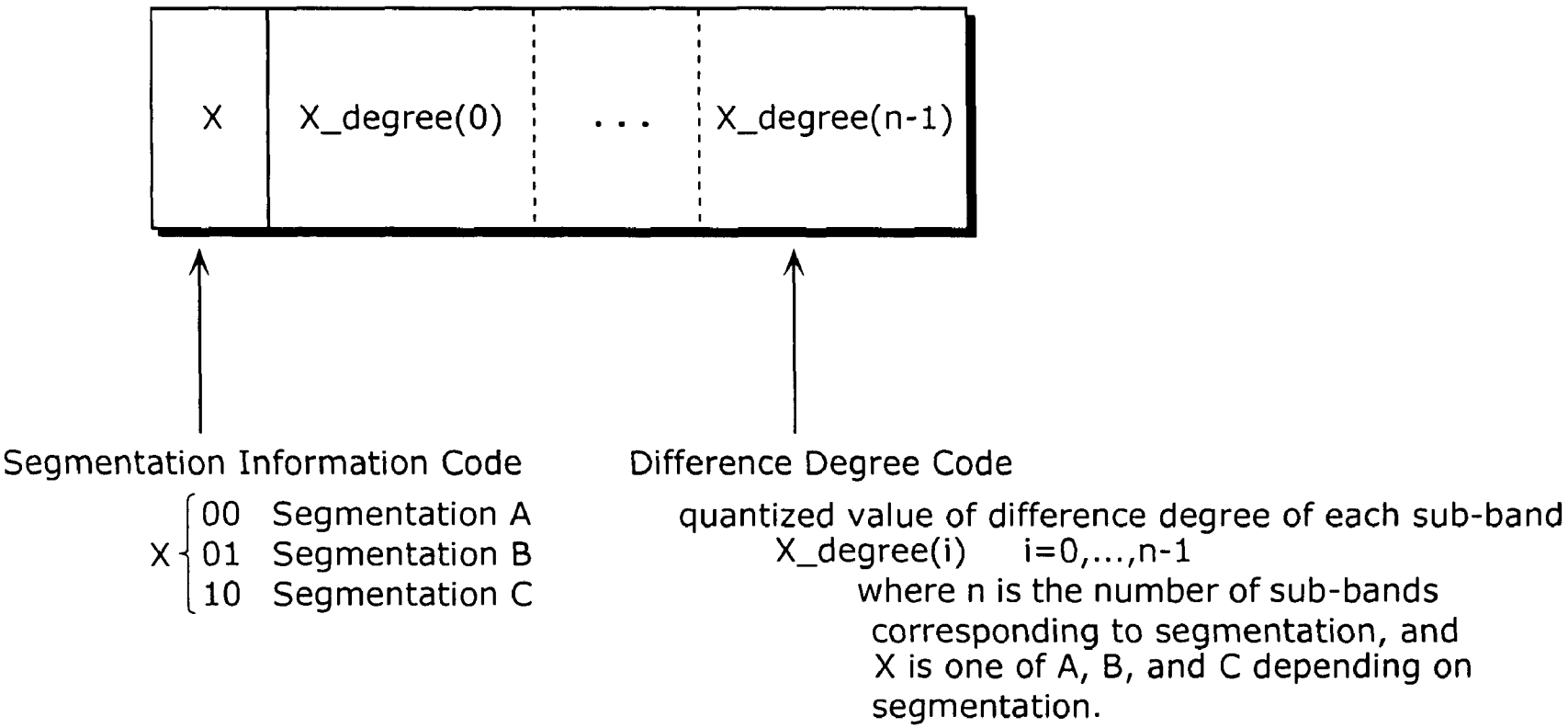
FIG. 3 is a diagram showing one example of a segmentation information code and difference degree codes.

FIG. 3 is a diagram showing one example of the segmentation information code and the difference degree codes generated by the difference degree and segmentation information encoding unit 105.

In the example of FIG. 3, the segmentation information code X is one of two-bit values "00", "01", and "10" corresponding to the segmentation A, the segmentation B, and the segmentation C, respectively. The difference degree code is a value obtained by quantizing and encoding X_degree(i) (where i=0, . . . , n−1; n is the number of sub-bands corresponding to segmentation; and X is A, B, or C depending on the segmentation) which is a difference degree regarding each sub-band calculated by the difference degree calculation unit 101, 102, or 103, depending on the segmentation.

Figure 4:
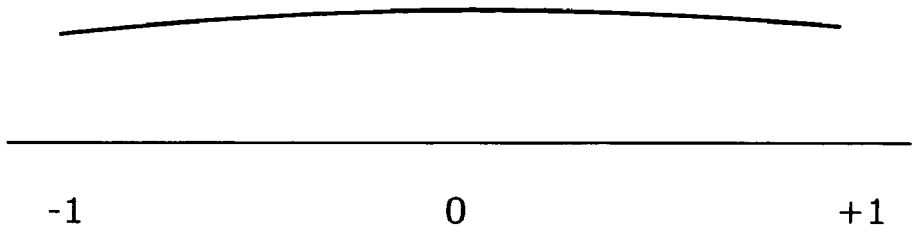
FIGS. 4 (A), (B), and (C) shows diagrams explaining a concept of generation of the difference degree code.
Figure 4:
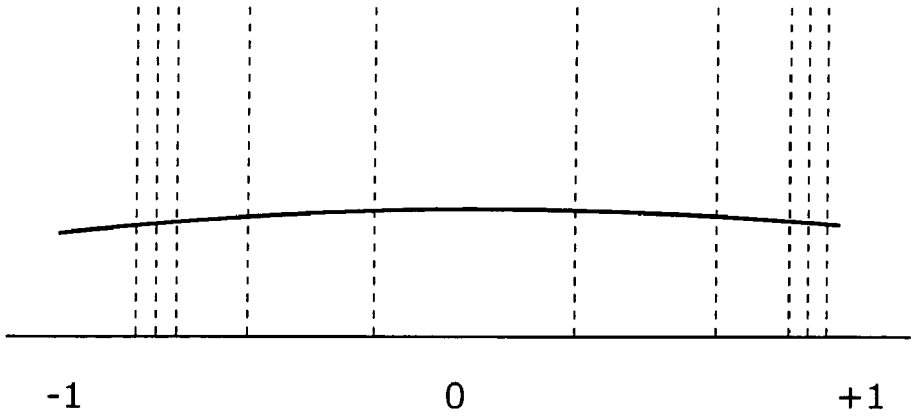

FIGS. 4 (A), (B), and (C) are diagrams explaining a concept of generation of the difference degree codes.

FIG. 4(A) shows one typical example of occurrence frequency distribution of ICC, assuming that the difference degrees are ICC. This example shows that ICC are distributed almost equally between a value of +1 to a value of −1.

FIG. 4(B) shows one example of a quantization grid used to quantize the ICC. When the ICC is +1, the signals are in phase with each other, while when the ICC is −1, the signals are in anti-phase. In general, discrimination sensitivity of the human hearing sense regarding ICC is high around the in-phase (ICC=+1) and the anti-phase (ICC=−1), where a human being can discriminate a subtle difference between ICC values. However, the discrimination sensitivity is low around correlation absence (ICC=0), where a human being has difficulty of discriminating difference between ICC values. The quantization grid example in FIG. 4(B) is determined in consideration of such human hearing sense characteristics.

FIG. 4(C) is one example of Huffman code structured depending on the ICC occurrence frequency distribution shown in FIG. 4(A) and the quantization grid shown in FIG. 4(B). FIG. 4(C) shows a representative value of each quantization grid, and a Huffman code length corresponding to the representative value.

Note that an area of the quantization grid which is cut by an occurrence frequency distribution curve corresponds to an occurrence frequency of the representative value. For example, representative values ±1 with a low occurrence frequency is allocated with 9 bits, while representative values ±0.5 with a high occurrence frequency is allocated with 2 bits.

By such allocation of the number of bits, as known in the art, the Huffman code whose average code length is minimum is obtained.

However, there is a problem when audio signals, which are always in-phase or anti-phase, are inputted. As one typical example, when a monaural signal is merely inputted into right and left channels, if the above-described Huffman code is applied, ICC is expressed by 9 bits always for every unit encoding time. This results in generating quite long codes, which is contrary to expectation of minimizing the average coding length. Especially, if ICC of each of n sub-bands is encoded, a 9n-bit code is generated every unit encoding time, so that the larger the number of the sub-bands is, the more the coding length is influenced.

Therefore, it is conceived that a representative value of each sub-band is expressed by: a 1-bit code for indicating whether or not all representative values are equal; and a 9-bit code for representing the equal representative value (+1, for example), if all representative values are equal. Using this expressing method, it is possible to transmit, for each unit time, ICC whose data amount is up to 10 bits that is less than 9n bits, even if representative values obtained from signals are always equal.

The multiplexing unit 108 multiplexes: the segmentation information code and the phase difference degree codes obtained by the difference degree and segmentation information encoding unit 105; and the representative signal code obtained by the representative signal encoding unit 107, into encoded audio signal data, and generates a bit-stream expressing the encoded audio signal data.

Next, processing performed by the variable frequency segmentation encoding unit 110 in the audio encoding device 100 is described.

Figure 5:
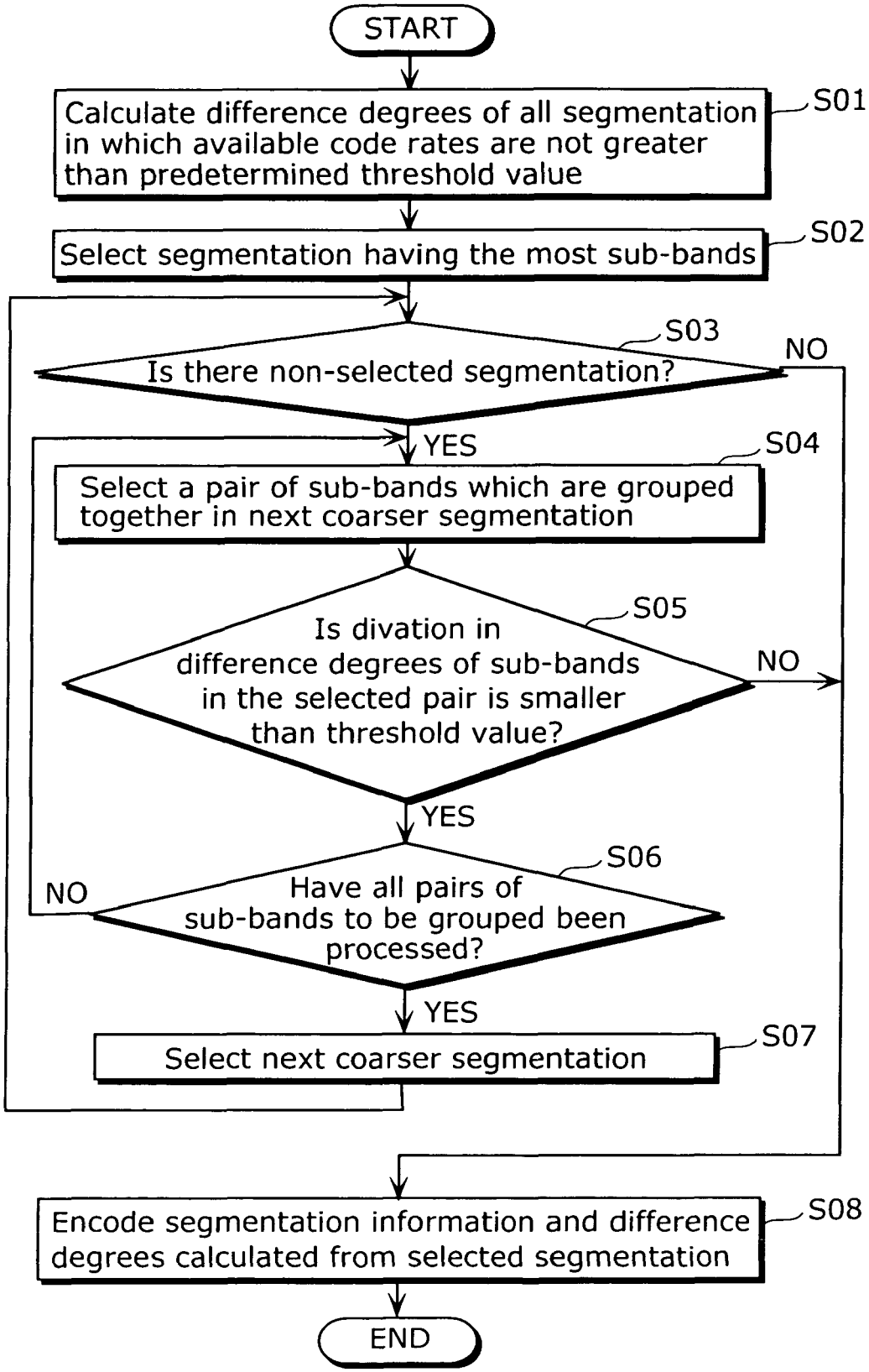
FIG. 5 is a flowchart showing one example of processing performed by the audio encoding device according to the present embodiment.

FIG. 5 is a flowchart showing one appropriate example of the processing performed by the variable frequency segmentation encoding unit 110 is described.

Among the difference degree calculation units 101, 102 and 103, difference degree calculation units, which correspond to segmentation in which eventual code rates are not greater than a predetermined threshold value, perform difference degree calculation (S01). The selection unit 104 selects one segmentation having the most sub-bands, from the above calculating segmentation candidates (S02).

If there is still segmentation which has not yet been selected (YES at S03), then a pair of sub-bands in the next coarse segmentation is selected (S04). Here, the pair of sub-bands is grouped together as a single sub-band in the next coarser segmentation. Then, if a deviation in the difference degrees calculated regarding the respective sub-bands in the pair is smaller than a predetermined threshold value (YES at S05), then another pair of sub-bands in the selected segmentation is selected, and a deviation in difference degrees calculated regarding the pair is compared to the predetermined threshold value. As a result, if the deviation in the difference degrees regarding every pair is smaller than the predetermined threshold value (YES at S06), then the next coarser segmentation is selected (S07), and the processing is repeated from the step S03 for the currently selected segmentation.

If there is no segmentation which has not yet been selected and the coarsest segmentation has been selected (NO at S03), or if the deviation in the difference degrees is greater than the predetermined threshold value (NO at S05), then the difference degree and segmentation information encoding unit 105 encodes the segmentation information for identifying the selected segmentation, and the difference degrees calculated by the difference degree calculation unit correspond to the selected segmentation (S08).

(Audio Decoding Device 200)

Referring again to FIG. 1, the audio decoding device 200 is a device which decodes the encoded audio signal data into plural audio signals. The encoded audio signal data is expressed by the bitstream which the audio encoding device 100 generates. The audio decoding device 200 includes a de-multiplexing unit 201, a variable frequency segment decoding unit 210, a representative signal decoding unit 207, a frequency transformation unit 208, and a separating unit 209. The variable frequency segment decoding unit 210 has a segmentation information decoding unit 202, a switching unit 203, and difference degree decoding units 204, 205, and 206.

The de-multiplexing unit 201 de-multiplexes the bitstream generated by the audio encoding device 100, into the segmentation information code, the difference degree codes, and the representative signal code. Then, the segmentation information code and the difference degree codes are outputted to the variable frequency segment decoding unit 210, and the representative signal code is outputted to the representative signal decoding unit 207.

The representative signal decoding unit 207 decodes the representative signal code into the representative audio signal.

The frequency transformation unit 208 transforms a time waveform per unit time of the representative audio signal into signals in frequency domain, and outputs the resulting signals to the separating unit 209.

The segmentation information decoding unit 202 decodes the segmentation information code into the segmentation information for identifying the segmentation selected in the encoding.

The switching unit 203 outputs the difference degree code to one difference degree decoding unit corresponding to the segmentation identified by the segmentation information, among the difference degree decoding units 204, 205, and 206.

As inverse processing of the quantization and the encoding performed by the difference degree and segmentation information encoding unit 105, the difference degree decoding unit 204 de-quantizes and decodes the difference degree code to each difference degree A_degree(n) n (n=0, . . . , 4) regarding the five sub-bands in the segmentation A, and then outputs the difference degree to the separating unit 209.

In the same manner, the difference degree decoding unit 205 decodes the difference degree code to each difference degree B_degree(n) n (n=0, 1, 2) regarding the three sub-bands in the segmentation B, and outputs the difference degree to the separating unit 209.

In the same manner, the difference degree decoding unit 206 decodes the difference degree code to a difference degree C_degree(0) regarding the whole area of the frequency band in the segmentation C, and outputs the difference degree to the separating unit 209.

As described above, this difference degree is expressed by ICC, ILD, and the like, in practical use.

The separating unit 209 generates two different frequency signals from the representative audio signal, by respectively modifying the representative audio signal in frequency domain obtained from the frequency transformation unit 208, depending on the difference degree for each sub-band obtained from the difference degree decoding unit 204, 205, or 206. Therefore, the two frequency signals are given with difference degrees for each sub-band. Then, the resulting two frequency signals are transformed to the first reproduced signal and the second reproduced signal in time domain, respectively.

This modification can be performed using an already known method, such as a method of adjusting correlation between reproduced signals by mixing the original representative audio signal whose amount corresponds to the ICC, into both of the two frequency signals which are obtained by giving the representative audio signal with a half value of level difference expressed by the ILD, in opposite directions.

With the above-described structure, the present invention can provide an effect of flexibly adjusting the optimal trade-off between a code rate and sound quality by selecting one of the plural frequency segmentation to be applied, and also an effect of improving coding efficiency by grouping plural sub-bands as a set.

Note that it has been described, as one example, that the representative signal decoding unit 207 outputs, as the representative audio signal in the time domain, the representative signal code read out from a bitstream, and that the frequency transformation unit 208 transforms the representative audio signal into signals in the frequency domain and outputs the resulting signals to the separating unit 209. However, when the representative signal code expresses a representative audio signal in the frequency domain for example, it is also possible to conceive a structure having a decoding unit, instead of the representative signal decoding unit 207 and the frequency transformation unit 208, in order to decode the representative signal code read out from the bitstream, thereby obtaining the representative audio signals in the frequency domain and output the resulting signals to the separating unit 209.

(Application to 5.1 Channel Audio)

The above-described variable frequency segment coding and decoding technologies can be applied to 5.1 channel audio processing.

Figure 6:
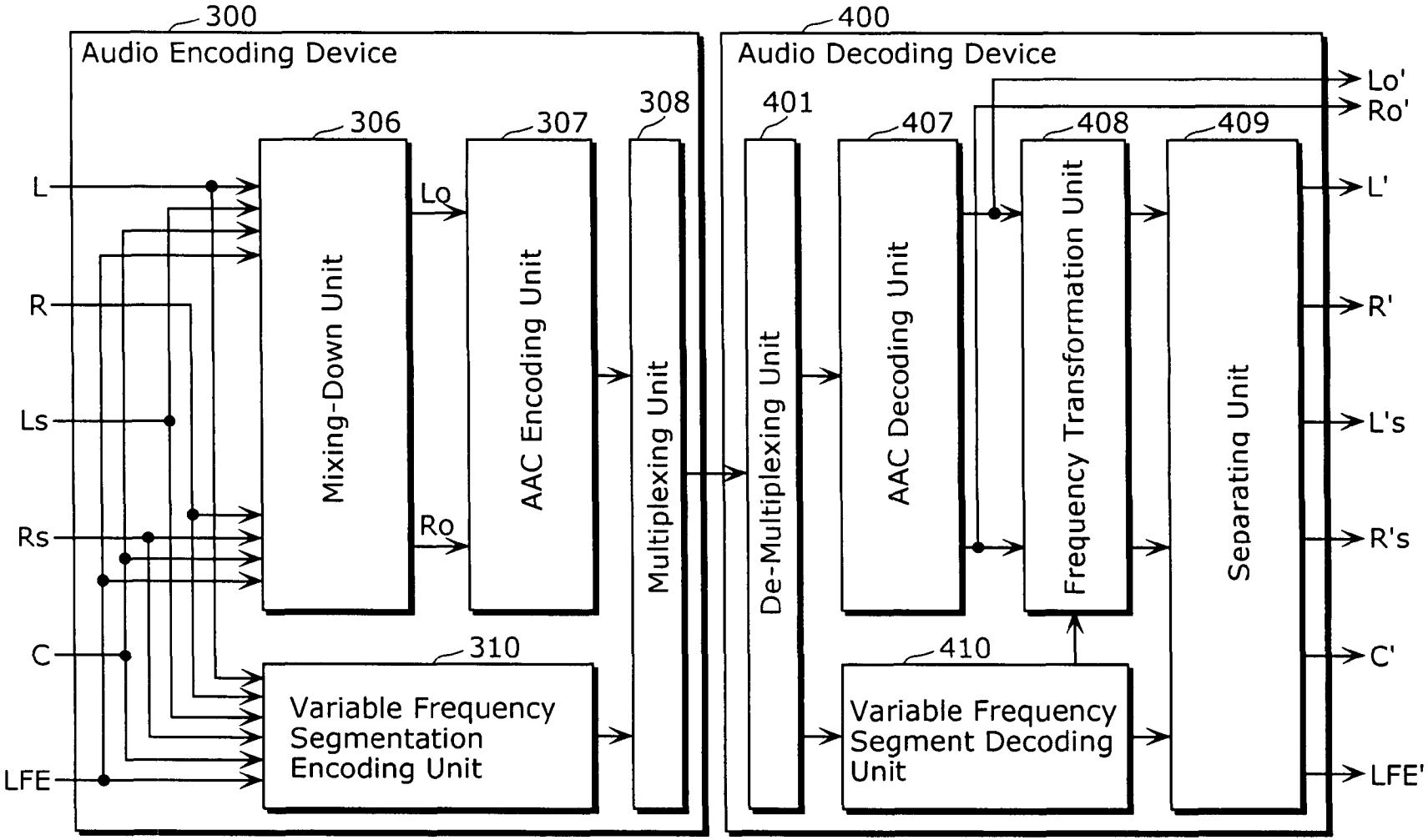
FIG. 6 is a block diagram showing another example of the functional structure of the audio encoding device and the audio decoding device.

FIG. 6 is a block diagram showing one example of the functional structure of the audio encoding device 300 and the audio decoding device 400 in the above example.

The audio encoding device 300 is a device which encodes 5.1 channel audio signals to generate encoded audio signal data. The 5.1 channel audio signals includes a left channel signal L, a right channel signal R, a left rear channel signal $L_S$, a right rear channel signal $R_S$, a center channel signal C, and a low frequency channel signal LFE. The encoded audio signal data represents: a left integrated channel signal $L_O$; a right integrated channel signal Ro; and a difference degree among the 5.1 channel audio signals. The audio encoding device 300 has a mixing-down unit 306, an AAC encoding unit 307, a variable frequency segmentation encoding unit 310, and a multiplexing unit 308.

The mixing-down unit 306 mixes the left channel signal L, the left rear channel signal $L_S$, the center channel signal C, and the low frequency channel signal LFE, down to the left integrated channel signal $L_O$, and also mixes the right channel signal R, the right rear channel signal $R_S$, the center channel signal C, and the low frequency channel signal LFE, down to the right integrated channel signal Ro.

The AAC encoding unit 307 encodes the left integrated channel signal $L_O$ and the right integrated channel signal $R_O$, thereby obtaining a single representative signal code, according to an audio Codec of a single channel defined by the AAC standard.

The variable frequency segmentation encoding unit 310 selects one of the plural frequency segmentation, then calculates each difference degree among the signals in the 5.1 channel audio signals, regarding each sub-band in the selected segmentation, and quantizes and encodes the resulting difference degree. The segmentation selection, the quantization, and the encoding are performed using the technology described for the audio encoding device 100.

Multiplexing unit 308 multiplexes: (i) the representative signal code representing the left integrated channel signal $L_O$ and the right integrated channel signal $R_O$, which is obtained from the AAC encoding unit 307; and (ii) a code representing the selected segmentation and codes representing the difference degrees among the 5.1 channel audio signals, which are obtained from the variable frequency segmentation encoding unit 310. Thereby, encoded audio signal data is obtained. Then, a bitstream is generated to represent the resulting encoded audio signal data.

The audio decoding device 400 is a device which decodes the encoded audio signal data expressed by the bitstream generated by the audio encoding device 300, thereby obtaining plural audio signals. The audio decoding device 400 includes a de-multiplexing unit 401, a variable frequency segment decoding unit 410, an AAC decoding unit 407, a frequency transformation unit 408, and a separating unit 409.

The de-multiplexing unit 401 de-multiplexes the bitstream generated by the audio encoding device 300 into the segmentation information code, the difference degree codes, and the representative signal code. Then the segmentation information code and the difference degree codes are outputted to the variable frequency segment decoding unit 210. The representative signal code is outputted to the AAC decoding unit 407.

The AAC decoding unit 407 decodes the representative signal code into a left integrated channel signal $L_O'$, and a right integrated channel signal $R_O'$. The frequency transformation unit 408 transforms a time waveform per each unit time regarding each of the left integrated channel signal $L_O'$ and the right integrated channel signal $R_O'$, into signals in frequency domain, and outputs the resulting signals to the separating unit 409.

Firstly, by decoding the segmentation information code into the segmentation information, the variable frequency segment decoding unit 410 learns the frequency segmentation selected in the encoding by the variable frequency segmentation encoding unit 310.

Next, as inverse processing of the quantization and the encoding performed by the variable frequency segmentation encoding unit 310, the difference degree code is de-quantized and decoded to a difference degree for each sub-band in the frequency segmentation.

Then, depending on the difference degree, each signal in frequency domain of the left integrated channel signal $L_O'$ and the right integrated channel signal $R_O'$ is modified, so that the audio signals L', R', $L_S'$, $R_S'$, C', and LFE' in the 5.1 channel are separated from one another to be reproduced.

With the above-described structure, even in the application to the 5.1 channel audio, as described above, the present invention can provide an effect of flexibly adjusting the optimal trade-off between a code rate and sound quality by selecting one of the plural frequency segmentation to be applied, and also an effect of improving coding efficiency by grouping plural sub-bands as a set.

Moreover, as shown in FIG. 6, if the left integrated channel signal $L_O'$ and the right integrated channel signal $R_O'$ are outputted to the outside, the signals can be listened to using a relatively simple device such as stereo headphones or a stereo speaker system, so that high usability is realized in practical use.

(Another Application)

Note that the two-channel audio and the 5.1 channel audio have been described as examples in order to explain the applicable embodiment of the present invention. However, the applicable scope of the present invention is not limited to encoding and decoding of original sound signals detected by such multi-channels.

For example, the present invention may be used to realize a sound effect which provides a monaural original sound signal with artificial extension or localization of sound image. In such a case, the representative signal is the monaural original sound signal itself rather than mixed-down signal, and the difference degree can be obtained, not by comparing plural signals with each other, but by calculating based on intended extension or localization of sound image.

The above case can be also applied with the variable frequency segment encoding and decoding according to the present invention, so that it is possible to realize the effect of flexibly adjusting the optimal trade-off between a code rate and sound quality by selecting one of the plural frequency segmentation to be applied, and also the effect of improving coding efficiency by grouping plural sub-bands as a set.

INDUSTRIAL APPLICABILITY

The audio encoding device and the audio decoding device according to the present invention can be used in various devices for encoding and decoding audio signals of multiple channels.

The encoded audio signal data according to the present invention can be used when audio contents and audio-visual contents are transmitted and stored, and more specifically when such content is transmitted in digital broadcasting, transmitted via the Internet to a personal computer or a portable information terminal device, recorded and reproduced in a medium such as a Digital Versatile Disk (DVD) or a Secure Digital (SD) card.

The invention claimed is:

1. An audio encoding device that encodes a degree of a difference between plural audio signals which are to be separated from a representative audio signal, said audio encoding device comprising:

a selecting unit operable to select one of plural segmentation methods for segmenting a frequency band into one or more sub-bands;

a difference degree encoding unit operable to encode the degree of the difference between the plural audio signals for each sub-band obtained by the selected segmentation method; and a segmentation information encoding unit operable to encode segmentation information for identifying the selected segmentation method, wherein a number of the sub-bands obtained by each of the plural segmentation methods differs depending on the segmentation method, wherein the plural segmentation methods include: a first segmentation method for segmenting the frequency band into one or more sub-bands; and a second segmentation method for segmenting the frequency band into plural sub-bands, and wherein one of the sub-bands obtained by the first segmentation method is equivalent to one of: one of the sub-bands obtained by the second segmentation method; and a frequency band in which at least two adjacent sub-bands obtained by the second segmentation method are grouped.

2. The audio encoding device according to the claim 1, further comprising a difference degree calculation unit operable to calculate the degree of the difference between the plural audio signals for each of the one or more sub-bands obtained by the first segmentation method and for each of the plural sub-bands obtained by the second segmentation method, wherein said selecting unit is operable to select one of the first segmentation method and the second segmentation method as the selected segmentation method depending on a deviation between the calculated degrees of the difference for the sub-bands obtained by the second segmentation method.

3. The audio encoding device according to the claim 1, wherein the degree of the difference is a difference in energy between the plural audio signals.

4. The audio encoding device according to the claim 1, wherein the degree of the difference is coherence between the plural audio signals.

5. The audio encoding device according to the claim 1, wherein the representative audio signal is a mixed-down signal to which the plural audio signals are mixed down.

6. A non-transitory computer readable recording medium having stored thereon encoded audio signal data that represents a degree of a difference between plural audio signals which are to be separated from a representative audio signal, said encoded audio signal data comprising:

a difference degree code in which the degree of the difference between the plural audio signals is encoded for each sub-band obtained by one of plural segmentation methods for segmenting a frequency band into one or more sub-bands; and a segmentation information code in which segmentation information for identifying the segmentation method used to encode the difference degree code is encoded wherein a number of the sub-bands obtained by each of the plural segmentation methods differs depending on the segmentation method, wherein the plural segmentation methods include: a first segmentation method for segmenting the frequency band into one or more sub-bands; and a second segmentation method for segmenting the frequency band into plural sub-bands, and wherein one of the sub-bands obtained by the first segmentation method is equivalent to one of: one of the sub-bands obtained by the second segmentation method; and a frequency band in which at least two adjacent sub-bands obtained by the second segmentation method are grouped.

7. An audio decoding device that decodes encoded audio signal data which includes: a difference degree code in which a degree of a difference between plural audio signals, which are to be separated from a representative audio signal, is encoded for each sub-band obtained by one of plural segmentation methods for segmenting a frequency band into one or more sub-bands; and a segmentation information code in which segmentation information for identifying the segmentation method used to encode the difference degree code is encoded, said audio decoding device comprising:

a segmentation information decoding unit operable to decode the segmentation information code to the segmentation information; and a difference degree information decoding unit operable to decode the difference degree code to the degree of the difference between the plural audio signals for each sub-band obtained by the segmentation method identified by the segmentation information, wherein a number of the sub-bands obtained by each of the plural segmentation methods differs depending on the segmentation method, wherein the plural segmentation methods include: a first segmentation method for segmenting the frequency band into one or more sub-bands; and a second segmentation method for segmenting the frequency band into plural sub-bands, and wherein one of the sub-bands obtained by the first segmentation method is equivalent to one of: one of the sub-bands obtained by the second segmentation method; and a frequency band in which at least two adjacent sub-bands obtained by the second segmentation method are grouped.

8. An audio encoding method of encoding a degree of a difference between plural audio signals which are to be sepa rated from a representative audio signal, said audio encoding method comprising steps of:

selecting, using a selecting unit, one of plural segmentation methods for segmenting a frequency band into one or more sub-bands;

encoding, using a difference degree encoding unit, the degree of the difference between the plural audio signals for each sub-band obtained by the segmentation method selected in said selecting; and encoding, using a segmentation information encoding unit, segmentation information for identifying the selected segmentation method, wherein a number of the sub-bands obtained by each of the plural segmentation methods differs depending on the segmentation method, wherein the plural segmentation methods include: a first segmentation method for segmenting the frequency band into one or more sub-bands; and a second segmentation method for segmenting the frequency band into plural sub-bands, and wherein one of the sub-bands obtained by the first segmentation method is equivalent to one of: one of the sub-bands obtained by the second segmentation method; and a frequency band in which at least two adjacent sub-bands obtained by the second segmentation method are grouped.

9. An audio decoding method of decoding encoded audio signal data which includes: a difference degree code in which a degree of a difference between plural audio signals, which are to be separated from a representative audio signal, is encoded for each sub-band obtained by one of plural segmentation methods for segmenting a frequency band into one or more sub-bands; and a segmentation information code in which segmentation information for identifying the segmentation method used to encode the difference degree code is encoded, said audio decoding method comprising steps of:

decoding, using a segmentation information decoding unit, the segmentation information code to the segmentation information; and decoding, using a difference degree information decoding unit, the difference degree code to the degree of the difference between the plural audio signals for each sub-band obtained by the segmentation method identified by the segmentation information, wherein a number of the sub-bands obtained by each of the plural segmentation methods differs depending on the segmentation method, wherein the plural segmentation methods include: a first segmentation method for segmenting the frequency band into one or more sub-bands; and a second segmentation method for segmenting the frequency band into plural sub-bands, and wherein one of the sub-bands obtained by the first segmentation method is equivalent to one of: one of the sub-bands obtained by the second segmentation method; and a frequency band in which at least two adjacent sub-bands obtained by the second segmentation method are grouped.

10. A non-transitory computer readable recording medium having stored thereon a program for encoding a degree of a difference between plural audio signals which are to be separated from a representative audio signal, wherein when executed, said program causes a computer to perform a method comprising steps of:

selecting one of plural segmentation methods for segmenting a frequency band into one or more sub-bands;

encoding the degree of the difference between the plural audio signals for each sub-band obtained by the segmentation method selected in said selecting; and encoding segmentation information for identifying the selected segmentation method, wherein a number of the sub-bands obtained by each of the plural segmentation methods differs depending on the segmentation method, wherein the plural segmentation methods include: a first segmentation method for segmenting the frequency band into one or more sub-bands; and a second segmentation method for segmenting the frequency band into plural sub-bands, and wherein one of the sub-bands obtained by the first segmentation method is equivalent to one of: one of the sub-bands obtained by the second segmentation method; and a frequency band in which at least two adjacent sub-bands obtained by the second segmentation method are grouped.

11. A non-transitory computer readable recording medium having stored thereon a program for decoding encoded audio signal data which includes: a difference degree code in which a degree of a difference between plural audio signals, which are to be separated from a representative audio signal, is encoded for each sub-band obtained by one of plural segmentation methods for segmenting a frequency band into one or more sub-bands; and a segmentation information code in which segmentation information for identifying the segmentation method used to encode the difference degree code is encoded, wherein when executed said program causes a computer to perform a method comprising steps of:

decoding the segmentation information code to the segmentation information; and decoding the difference degree code to the degree of the difference between the plural audio signals for each sub-band obtained by the segmentation method identified by the segmentation information wherein a number of the sub-bands obtained by each of the plural segmentation methods differs depending on the segmentation method, wherein the plural segmentation methods include: a first segmentation method for segmenting the frequency band into one or more sub-bands; and a second segmentation method for segmenting the frequency band into plural sub-bands, and wherein one of the sub-bands obtained by the first segmentation method is equivalent to one of: one of the sub-bands obtained by the second segmentation method; and a frequency band in which at least two adjacent sub-bands obtained by the second segmentation method are grouped.

* * * * *